US005625168A

United States Patent [19]

Van Siclen, Jr.

[11] Patent Number: 5,625,168

[45] Date of Patent: Apr. 29, 1997

[54] SECONDARY IGNITION LEAD STRUCTURE

[75] Inventor: Howard E. Van Siclen, Jr., San Diego, Calif.

[73] Assignee: Precision Engine Controls Corporation, San Diego, Calif.

[21] Appl. No.: 354,610

[22] Filed: Dec. 13, 1994

[51] Int. Cl.[6] ..... H01B 7/22

[52] U.S. Cl. ..... 174/102 R; 174/106 R; 174/107

[58] Field of Search ..... 174/102 R, 36, 174/107, 106

[56] References Cited

U.S. PATENT DOCUMENTS

| | | | |
|---|---|---|---|
| 3,287,489 | 11/1966 | Hvizd, Jr. | 174/102 |
| 3,327,050 | 6/1967 | Barrie | 174/107 |
| 3,790,697 | 2/1974 | Buckingham | 174/102 |
| 4,499,438 | 2/1985 | Cornelius et al. | 331/1 X |
| 4,861,945 | 8/1989 | Buck et al. | 174/69 X |
| 4,960,965 | 10/1990 | Redmon et al. | 174/102 R |
| 5,220,130 | 6/1993 | Walters | 174/36 |

*Primary Examiner*—Kristine L. Kincaid
*Assistant Examiner*—Chau N. Nguyen
*Attorney, Agent, or Firm*—Noel F. Heal

[57] ABSTRACT

A high-voltage lead intended for use in ignition systems of engines, typically large engines, the lead having an inner insulated conductor surrounded either by an inner conductive sleeve and an outer insulating sleeve, or by a single insulating sleeve with a conductive layer on its inner surface. The conductive sleeve or conductive layer, which is preferably non-metallic, provides shielding but permits the use of conventional pickup devices to detect electrical pulses in the lead and thereby monitor engine performance with the use of a timing light, oscilloscope or similar device. The presence of two insulating layers provides a desired measure of safety in the presence of an explosive gas and air mixture. The conductive layer provides both shielding and static electricity discharge. The structure of the invention is less expensive than ignition leads with conventional braided stainless steel shielding, and requires less effort and cost to maintain in safe condition.

10 Claims, 1 Drawing Sheet

SECONDARY IGNITION LEAD STRUCTURE

BACKGROUND OF THE INVENTION

This invention relates generally to insulated high-voltage conductors and, more particularly, to secondary ignition leads for large industrial internal combustion engines. Secondary ignition leads are used to conduct a high-voltage pulse from an ignition coil or other high voltage source to spark plugs or similar devices installed in engine cylinders. The term "secondary" and the related term "primary" are commonly used to distinguish the electrical connections to an ignition coil or similar device used to transform a relatively low voltage on the primary side of the device to a much higher voltage needed on the secondary side to produce an ignition spark.

The spark produced by the high-voltage pulse ignites a mixture of fuel and air in the engine cylinder. Combustion of the fuel moves a piston in the cylinder and rotates an engine crankshaft to which the piston is connected. Traditionally, secondary ignition leads have been unshielded, allowing easy access to the lead insulation and easy access to current and voltage probes for deriving information about the signals transmitted to the engine spark plug. These signals could trigger a timing light to determine and adjust the timing of the engine for optimum operation, and to supply a signal to an oscilloscope, to display such information as pulse shape, spark plug voltage firing levels, spark durations, frequency, number of restrikes, and open circuit firings. More complex engine analyzers use the same information picked up from the secondary lead, to analyze engine performance in more detail. More recently, safety of operation has become a more important issue and the only secondary lead approved by various approval agencies has been a shielded lead. Shielding was seen as the only way to prevent a secondary lead from arcing to an open grounded structure if the lead insulation broke down in the presence of an explosive mixture of gases near the engine. Therefore, shielding has become required for safety reasons, and to obtain the necessary agency approvals. External shielding has the additional advantage of providing increased physical strength to the secondary lead. Unfortunately, shielding totally precludes the detection of current in the lead, so timing lights, oscilloscopes and more complex engine analyzers are rendered inoperative.

Secondary leads in large engines have been shielded by means of a stainless steel braid with a TEFLON liner sleeve, installed over a silicone-insulated conductive lead. The steel braid inhibits undesired electromagnetic radiation from the ignition lead to the atmosphere and protects the insulated lead from external damage, such as physical damage sometimes inflicted by personnel climbing onto the engine. Although this structure is quite rugged, it has a number of disadvantages, one of which is that a conventional timing light cannot be used on the shielded secondary lead to determine how the engine cylinder timing is performing. A timing light is a strobe device commonly used to monitor the adjustment of the timing of one ignition pulse with respect to the angular position of the engine crankshaft and the associated position of the piston in the cylinder. The timing light uses a pickup device, such as an inductive or capacitive pickup to detect a current or voltage pulse in the ignition lead, and this technique is rendered difficult or ineffective by the presence of a grounded metal braid around the lead.

Another disadvantage of the stainless steel braid is that the spark signal cannot be monitored by an oscilloscope pickup for relative spark voltage for breakdown, to measure spark or arc duration, restrikes, misfires, and other wave shape information that can be easily obtained through an unshielded ignition lead. Further disadvantages are the relatively high cost of the braid and the need for continual maintenance to keep the shielded secondary lead and its associated hardware ground connection in good condition.

An additional significant concern relating to secondary ignition leads is safety from inadvertent ignition of leaking explosive gas. Large industrial engines are commonly fueled by natural gas, so there is always the potential for accumulation of gas near the engine and for an explosion to be ignited by a spark from a malfunctioning ignition lead. The conventional braided-shield ignition lead achieves an acceptable level of safety by including a TEFLON inner liner sleeve between the braid and the insulation around the lead itself. Safety considerations are given a high priority by testing and standards organizations and any new secondary ignition lead must satisfy the requirements of these organizations. Although the conventional braided lead is approved for use, it has been criticized for its inability to accommodate a standard timing light and the elimination of spark signal information. There have also been industry concerns about the maintenance needed to keep the shielded lead in good condition, to make sure it passes or stays within the requirements for approval.

Accordingly, there is still room for improvement in secondary ignition lead structures. Ideally, it would be desirable to provide a shielded lead that could be used with conventional timing lights, to provide spark signal wave/shape information, and that meets or exceeds safety requirements. The present invention is directed to this end.

SUMMARY OF THE INVENTION

The present invention resides in an ignition lead having no external braided shield, but providing a high degree of safety, reducing electromagnetic radiation and allowing the use of conventional probes to monitor engine performance. Briefly, and in general terms, the ignition lead of the invention comprises an insulated inner conductor, a conductive layer over the insulated conductor, to function as a shield, and an insulating layer over the conductive layer. In one embodiment of the invention, the conductive layer and the insulating layer are separate, generally concentric sleeves. In another embodiment, the conductive layer and the insulating layer are formed in a single sleeve. In either case, the conductive layer is preferably of non-metallic material having a resistance higher than that of conventional metallic shields. Therefore, conventional pickup devices can be used to detect current and voltage pulses in the conductor.

More specifically, in the illustrative embodiments of the invention the sleeve material is a fluorocarbon (such as TEFLON) or silicone rubber. For the embodiment in which one sleeve contains both the conductive and insulating layers, the conductive layer is formed by carbon or a similar non-metallic conductor impregnated in the sleeve material near its inner surface, to provide the required conductive layer.

In another variant of the invention, the conductive layer may be combined on the outside of the insulating layer that covers the inner conductor. Yet another option is to form the conductive layer over the outer surface of the outer insulating layer, but this would be less desirable from a safety standpoint because of the possibility that the outer layer could become statically charged or could cause a spark in the event of breakdown of the insulating layer.

It will be appreciated from the foregoing that the present invention represents a significant advance in the construction of high-voltage leads for engine ignition systems. In particular, the lead structure of the invention provides electromagnetic shielding but still permits the use of conventional timing lights, oscilloscope probes and similar devices to monitor engine performance, as well as allowing oscilloscope monitoring of the spark signal for additional information. In addition, the ignition lead of the present invention is less expensive to manufacture and maintain and still provides a high level of safety in the presence of explosive gas. Additional aspects and advantages of the invention will become apparent from the following more detailed description, considered with the accompanying drawings.

DESCRIPTION OF THE PREFERRED EMBODIMENT

Figure 2:
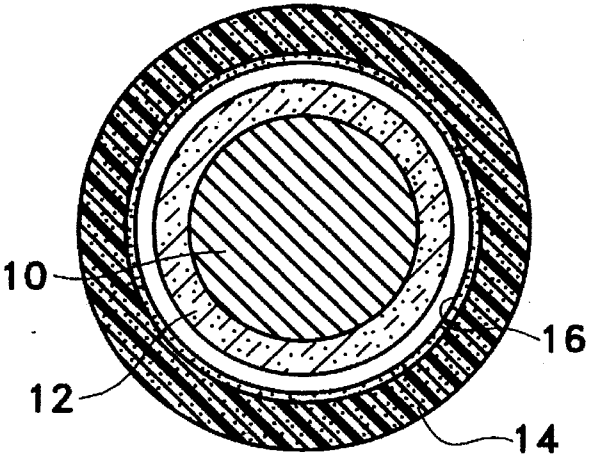
FIG. 2 is a cross-sectional view of the ignition lead of FIG. 1, taken generally along the line 2—2 of FIG. 1.
Figure 1:
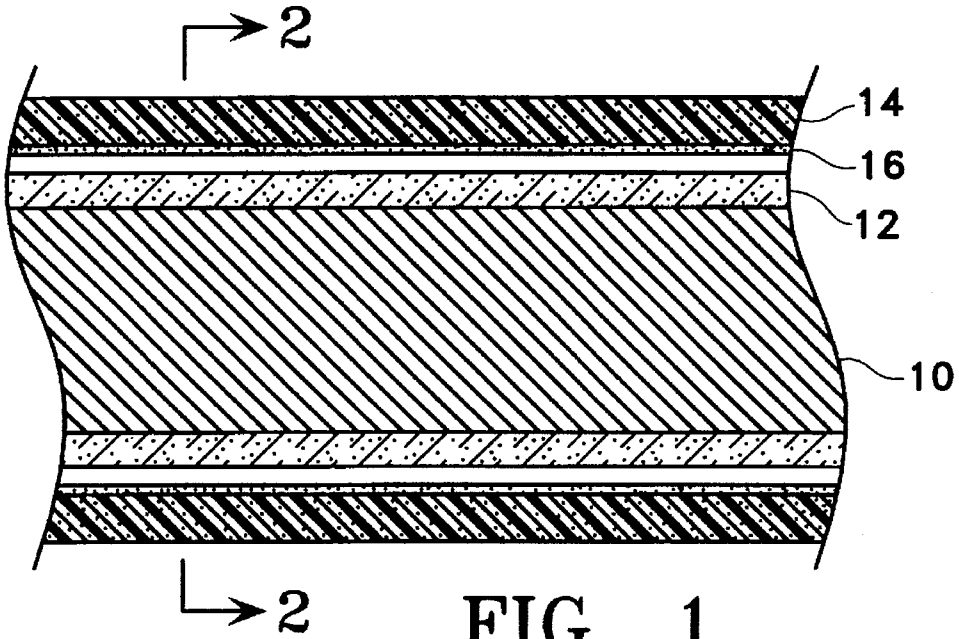
FIG. 1 is a cross-sectional view through a longitudinal axis of a portion of a high-voltage ignition lead constructed in accordance with the present invention.

As shown in the drawings for purposes of illustration, the present invention pertains to a high-voltage ignition lead construction which, although shielded, does not use conventional external metal braiding but does allow the use of conventional timing lights and oscilloscope monitoring for spark signal information. As is conventional, the lead includes a solid or stranded conductor of copper or other suitable metal, indicated by reference numeral 10, surrounded by an insulating layer 12 of silicone, neoprene or another suitable insulator. In accordance with the invention, the insulated conductor 10 and 12 is installed in an insulating sleeve 14 of a fluorocarbon, such as TEFLON, which is a form of polytetrafluoroethylene (PTFE), or a similar material, and the sleeve has a conductive layer 16 formed on its inner surface. Alternatively, this layer 16 could be a separate conductive sleeve between the sleeve 14 and the insulating layer 12. For purposes of illustration, in FIGS. 1 and 2 a space is shown between the insulating layer 12 and the sleeve 14, but in practice the sleeve may fit snugly over the insulating layer.

The conductive sleeve or layer 16 is preferably nonmetallic. For example, the TEFLON inner surface material of the sleeve 14 may be impregnated with carbon. In one known manufacturing process, called co-extrusion, the sleeve 14 may be made using carbon-filled TEFLON on the inside and pure TEFLON on the outside at the same time. The conductive sleeve or layer 16 has a higher resistance than a stainless steel braid and conventional pickup devices (not shown, such as a capacitive or inductive pickup) are, therefore, able to detect a current or voltage pulse in the conductor 10 more readily than if the conductor were shielded with an external steel braid. The coextrusion process is presently preferred over a separate conductive sleeve 16, because a coextruded sleeve will accommodate most timing light probes. The use of a separate conductive sleeve 16 would require a larger overall diameter and special timing light probes.

Should a break occur in the lead insulation 12, ignition of any explosive gas between the insulation 12 and the TEFLON sleeve 14 would be prevented from spreading further by the presence of the sleeve 14, acting as a pressure tubing to contain an explosion. An explosion would require at least three and as many as four fault conditions: a break in the lead insulation 12, the presence of an explosive gas between the lead 10 and the sleeve 14, a break in the sleeve 14, and the presence of explosive gas outside the sleeve 14. If there is no explosive gas within the sleeve 14 but there is a break in the lead insulation 12, an arc may occur between the lead 10 and the conductive layer 16 on the sleeve 14. However, the arc would not extend through the sleeve 14 unless the sleeve were also defective. Even then, the voltage output would be limited to 5 kv by the conductive layer 16. Simply stated, there has to be a break in both the conductor insulation 12 and in the TEFLON sleeve 14 before the presence of an explosive gas around the entire structure can be ignited by a spark from the ignition lead 10. Because of these safety considerations, the lead structure of the invention can meet the requirements of various approval agencies without difficulty.

A significant aspect of the invention is that the costs of manufacture and maintenance of the lead of the invention are significantly lower than corresponding costs for a conventional high-voltage lead shielded by a stainless steel braid. No external braid is needed in the structure of the invention, but if a braid is deemed necessary for further mechanical strength or protection, it should be of a nonconductive but high-strength material, such as KEVLAR. The addition of a braid would, however, require special timing light probes because of the larger diameter.

Figure 3:
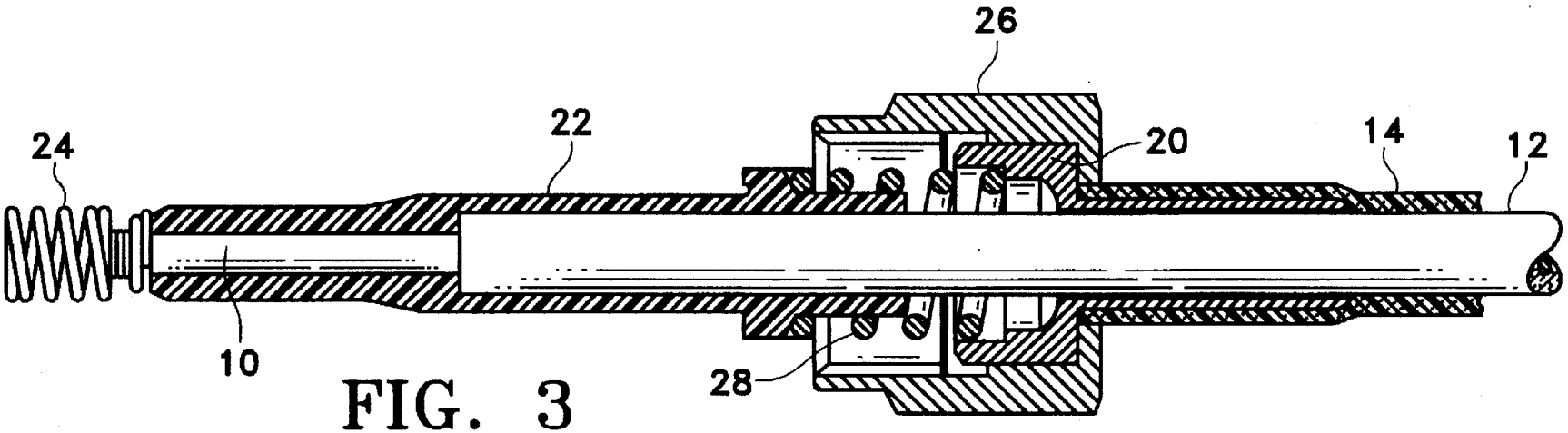
FIG. 3 is a cross-sectional view, at a reduced scale, through the longitudinal axis of a terminal assembly at an end of a lead of the type shown in FIGS. 1 and 2.

Various terminal structures may be adapted for use with the ignition lead of the invention. One is shown by way of example in FIG. 3. The insulated lead 10 and 12 extends into a ferrule 20 having an elongated thin-wall cylindrical portion sized to receive the insulated lead internally. The sleeve 14 extends over the outer surface of the cylindrical portion of the ferrule 20 to form a good seal and ground connection to the conductive surface 16 of the sleeve. The insulated lead extends through the ferrule 20 and into a second insulator sleeve 22. The conductor 10 extends out of the second insulator sleeve 22 and is connected at its end to a terminal spring 24. The structure also includes a terminal nut 26 that surrounds an enlarged portion of ferrule 20 and part of the insulator sleeve 22, and a compression spring 28 disposed inside the nut and bearing on annular surfaces of both the ferrule 20 and the insulator sleeve 22. The conductive layer 16 makes contact with the ferrule 20 and is, therefore, electrically connected to the nut 26, which typically engages a grounded structure when the lead is in use. The terminal spring 24 contacts the source of high voltage, typically an ignition coil, or a terminal of a spark plug or similar ignition device.

It will be appreciated from the foregoing that the present invention represents a significant advance over high-voltage leads of the prior art. In particular, the ignition lead of the invention may be used with conventional timing lights and probes but still includes a conductive, and preferably nonmetallic, layer. The lead of the invention also meets safety requirements by providing two independent layers that must both be defective before an unwanted spark can be generated. Moreover, the lead of the invention is relatively inexpensive to manufacture and maintain. It will also be appreciated that, although an embodiment of the invention has been described in detail, various modifications may be made without departing from the spirit and scope of the invention. Accordingly, the invention should not be limited except as by the appended claims.

I claim:

1. A high-voltage lead with no outer metallic shield, the high-voltage lead comprising:

an insulated inner conductor;

a conductive layer over the insulated conductor, the conductive layer being of non-metallic material having a resistance higher than that of metallic shields, whereby safety from possible arcing to a ground external to the lead is achieved but conventional pickup devices can still be used to detect electrical pulses in the inner conductor; and an insulating layer over the conductive layer.

2. A high-voltage lead as defined in claim 1, wherein:

the conductive layer takes the form of a conductive sleeve; and the insulating layer takes the form of a separate sleeve over the conductive sleeve.

3. A high-voltage lead as defined in claim 2, wherein:

the conductive sleeve material is a plastic impregnated with carbon particles throughout its thickness.

4. A high-voltage lead as defined in claim 1, wherein:

the conductive layer and the insulating layer are combined in a single sleeve.

5. A high-voltage lead as defined in claim 4, wherein:

the sleeve is impregnated with carbon near its inner surface, to provide the conductive layer.

6. A high-voltage lead as defined in claim 5, wherein:

the insulating layer of the sleeve is of a fluorocarbon material.

7. A high-voltage lead as defined in claim 5, wherein the insulating layer of the sleeve is of a silicone rubber material.

8. A high-voltage secondary ignition lead with no outer metallic shield, the lead comprising:

an inner conductor;

a surrounding layer of insulating material;

a conductive non-metallic layer over the insulating material; and an additional insulating layer over the conductive non-metallic layer;

wherein the conductive layer has a resistance higher than that of metallic shields, whereby safety from possible arcing to a ground external to the lead is achieved but conventional pickup devices can still be used to detect electrical pulses in the inner conductor.

9. A high-voltage secondary ignition lead as defined in claim 8, wherein:

the conductive non-metallic layer and the additional insulating layer are formed as a single sleeve; and the single sleeve is formed with carbon particles impregnated near its inner surface.

10. A high-voltage secondary ignition lead as defined in claim 9, wherein:

the sleeve is of a fluorocarbon material.

* * * * *